US006156986A

United States Patent [19]

Tsai

[11] Patent Number: 6,156,986

[45] Date of Patent: Dec. 5, 2000

[54] COMPUTER KEY SWITCH

[75] Inventor: Huo-Lu Tsai, Taichung Hsien, Taiwan

[73] Assignee: Jing Mold Enterprise Co., Ltd., Taiwan

[21] Appl. No.: 09/476,742

[22] Filed: Dec. 30, 1999

[51] Int. Cl.[7] ..... H01H 13/70

[52] U.S. Cl. ..... 200/345; 200/344

[58] Field of Search ..... 200/344–345

[56] References Cited

U.S. PATENT DOCUMENTS

| | | | |
|---|---|---|---|
| 4,755,645 | 7/1988 | Naoki et al. | 200/340 |
| 5,215,187 | 6/1993 | Ping-Chieng et al. | 200/517 |
| 5,283,408 | 2/1994 | Chen | 200/345 |
| 5,399,824 | 3/1995 | Chen | 200/534 |
| 5,938,009 | 8/1999 | Huang | 200/517 |
| 5,973,281 | 10/1999 | Tsai | 200/344 |
| 5,990,435 | 11/1999 | Chao | 200/517 |

*Primary Examiner*—Michael L. Gellner
*Assistant Examiner*—Nhung Nguyen
*Attorney, Agent, or Firm*—Connolly Bove Lodge & Hutz LLP

[57] ABSTRACT

A computer key switch, which includes a hollow key switch base supported on a membrane circuit above a frame, a rubber cone mounted on the membrane circuit inside the key switch base, and a key cap supported on the rubber cone for depressing with the finger to compress the rubber cone in triggering the membrane circuit, wherein the key cap has a plunger of H-shaped cross section supported on the rubber cone, and two hook rods symmetrically longitudinally suspended in open spaces defined in the plunger at two opposite sides, the plunger has longitudinally extended guide ribs formed integral with the periphery thereof and disposed in contact with the inside wall of the key switch base to guide vertical movement of the key cap relative to the key switch base; the key switch base has two hooks bilaterally disposed on the inside at the top for stopping hooks at the hook rods to limit up stroke of the key cap.

3 Claims, 4 Drawing Sheets

COMPUTER KEY SWITCH

BACKGROUND OF THE INVENTION

The present invention relates to a key switch for a computer keyboard, and more particularly to such a computer key switch, which enables the key cap to be smoothly stably moved up and down during operation.

A key switch for a computer keyboard is generally comprised of a rubber cone mounted on a membrane circuit above a frame, and a key cap having a bottom plunger inserted through an axle hole on a locating board and supported on the rubber cone. When the key cap is depressed, the plunger is lowered with the key cap to compress the rubber cone, causing the rubber cone to trigger a corresponding contact at the membrane circuit. This structure of key switch is still not satisfactory in function. If the applied force is not employed to the center area of the key cap, the key cap tends to be tilted, causing the plunger to be stuck in the axle hole on the locating board. Taiwan Patent Publication #370220 and #194192 disclose two structures of key switch for computer keyboard. In these two structures of key switch, an additional spring member and a spring cap are installed to support and guide movement of the key cap. These two structures of key switch are complicated and expensive to manufacture. Further, if the user depresses the corner area of the key cap, the applied force cannot be evenly distributed through the plunger of the key cap, thereby causing the key cap to be tilted during its movement, resulting in a triggering error.

SUMMARY OF THE INVENTION

The present invention provides a computer key switch, which eliminates the aforesaid drawbacks. According to the present invention, the computer key switch comprises a frame, a membrane circuit mounted on the membrane, a key switch base mounted on the membrane circuit, a rubber cone supported on the membrane circuit inside the key switch base, and a key cap coupled to the key switch base for depressing by hand to compress the rubber cone in triggering the membrane circuit to output a signal, wherein the key cap comprises a downwardly extended plunger of H-shaped cross section, and two symmetrical hook rods, the plunger comprising eight longitudinally extended guide ribs formed integral with the periphery thereof and disposed in contact with an inside wall of the key switch base for enabling the key cap to be moved up and down relative to the key switch base; the key switch base is a hollow shell comprising an upper frame board, and a bottom frame board, the upper frame board being a hollow, rectangular structure in which the plunger of the key cap is moved up and down with the key cap, an inside wall disposed in contact with the guide rids of the plunger of the key cap, and two hooks formed integral with the inside wall at two opposite sides corresponding to the hook rods to limit up stroke of the key cap; the rubber cone is mounted inside the bottom frame board and supported on the membrane circuit above the frame, comprising a top bearing portion, which supports the plunger of the key cap, and a triggering rod suspended on the inside and spaced above the membrane circuit for triggering a contact at the membrane circuit upon down stroke of the key cap.

DETAILED DESCRIPTION OF THE PREFERRED

EMBODIMENT

Figure 1:
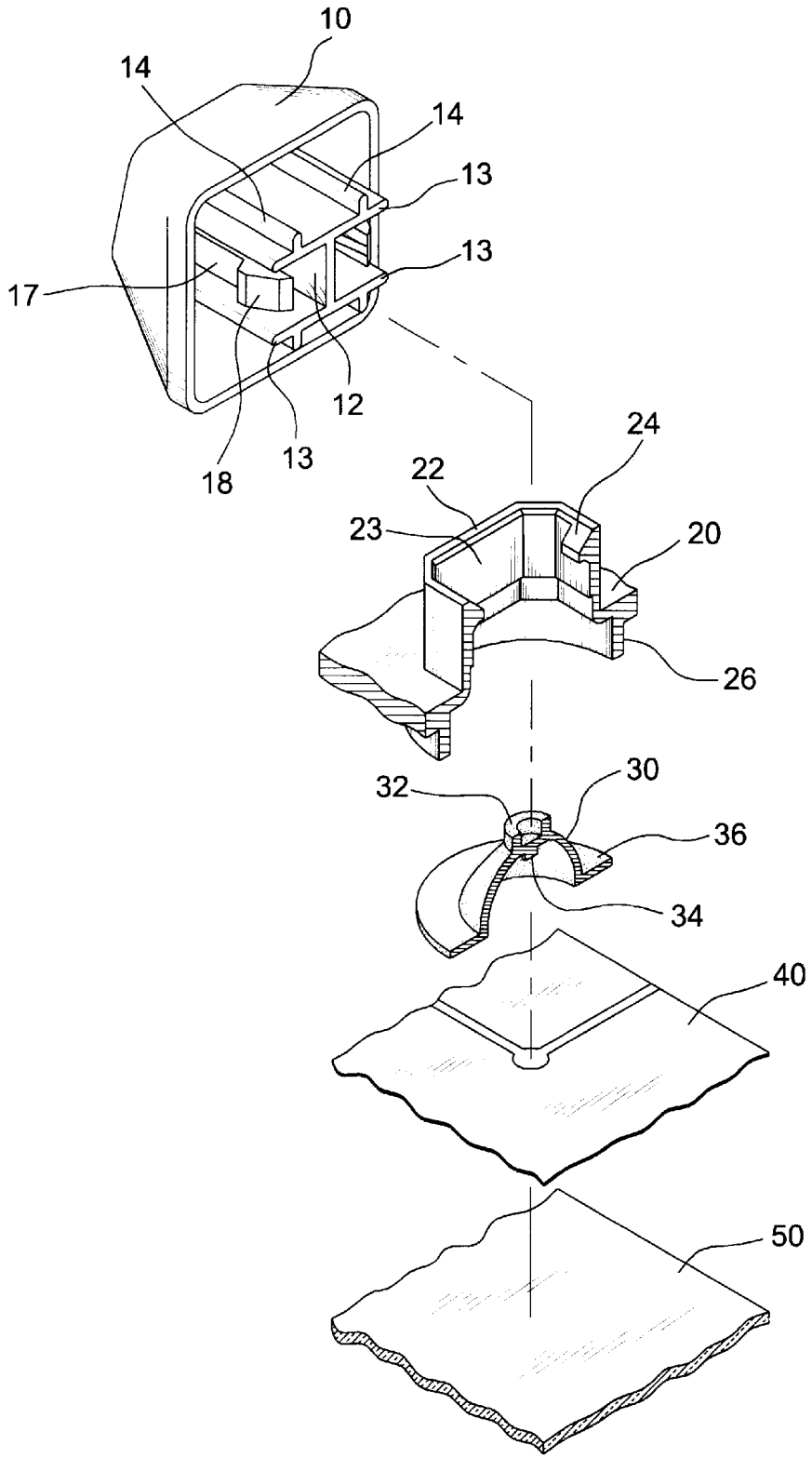
FIG. 1 is an exploded view of a computer key switch according to the present invention.
Figure 2:
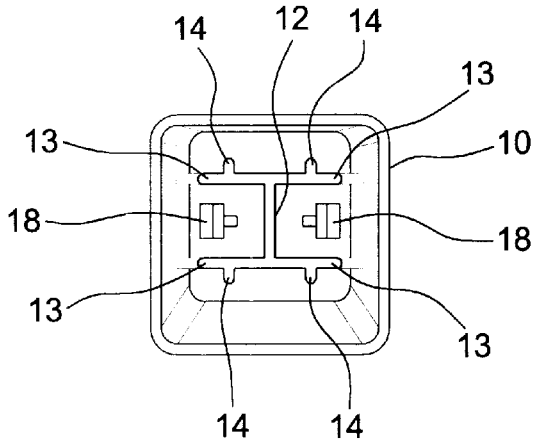
FIG. 2 is a bottom view of the key cap for the computer key switch according to the present invention.
Figure 3:
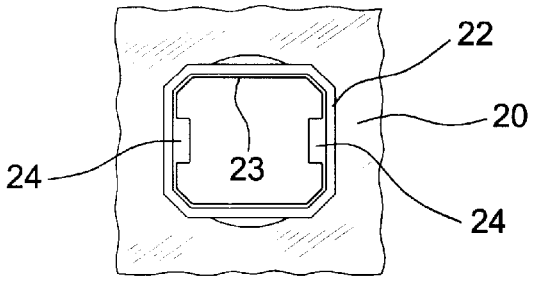
FIG. 3 is a top view of the key switch base for the computer key switch according to the present invention.

Referring to the annexed drawings in detail, a computer key switch in accordance with the present invention is shown comprised of a key cap 10, a key switch base 20, a rubber cone 30, a membrane circuit 40, and a frame 50.

Figure 4:
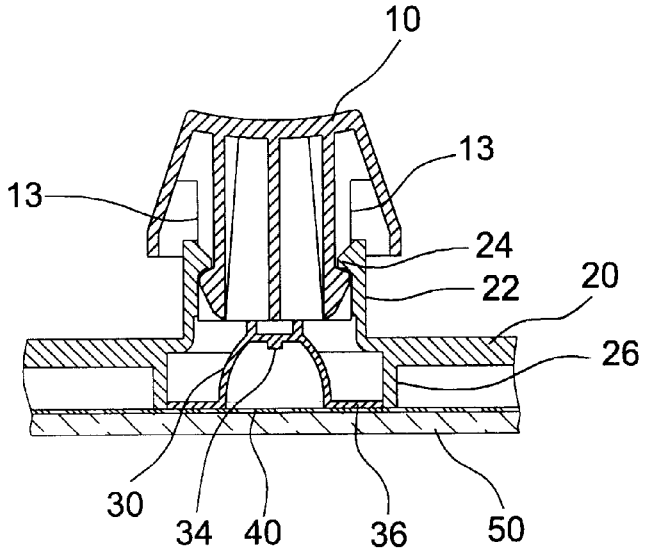
FIG. 4 is a sectional assembly view of the computer key switch according to the present invention.
Figure 5:
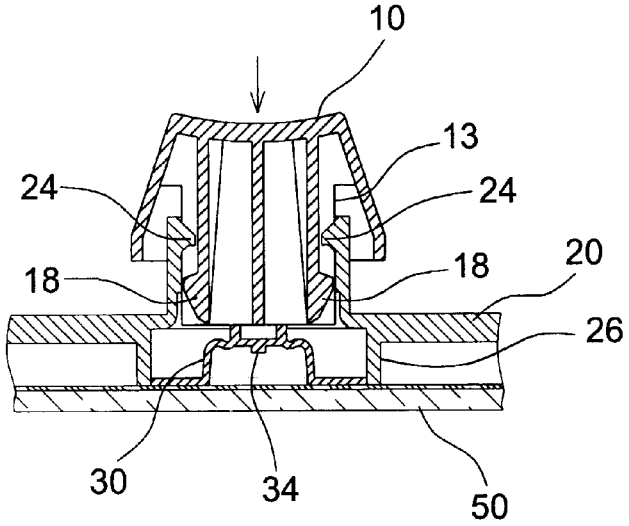
FIG. 5 is similar to FIG. 4 but showing the key cap depressed, the rubber cone compressed.
Figure 6:
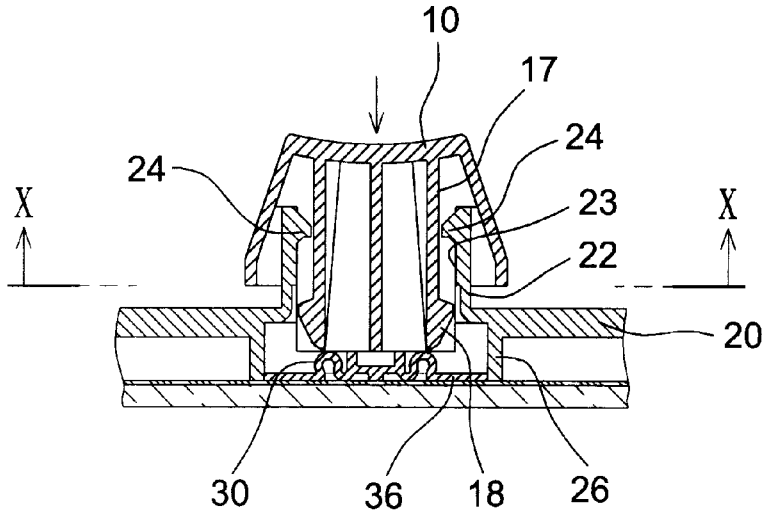
FIG. 6 is similar to FIG. 5 but showing the triggering rod of the rubber cone pressed on the membrane circuit.
Figure 7:
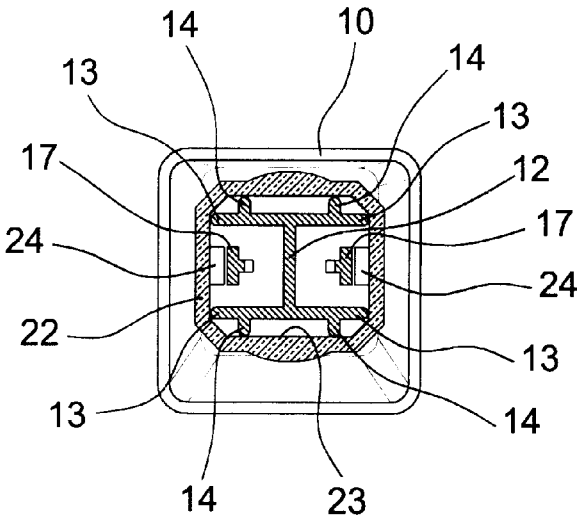
FIG. 7 is a sectional view taken along line X—X of FIG. 6.

The key cap 10 comprises a downwardly extended plunger 12 of H-shaped cross section, and two hook rods 17 symmetrically longitudinally suspended in the open spaces defined in the plunger 12 at two opposite sides. The plunger 12 comprises four corner guide ribs 13 longitudinally extended in four corners thereof, and two pairs of side guide ribs 14 longitudinally extended two opposite lateral side walls thereof. The guide ribs 13 and 14 each have a smoothly curved periphery. The hook rods 17 each have a bottom end terminating in an outward projected hook 18. The key switch base 20 is a hollow shell comprising an upper frame board 22, and a bottom frame board 26. The upper frame board 22 has a hollow, rectangular structure in which the plunger 12 is moved up and down with the key cap 10. The guide ribs 13 and 14 of the plunger 12 are disposed in contact with the inside wall 23 of the upper frame board 22, so that the plunger 12 can be smoothly stably moved with the key cap 10 up and down in the upper frame board 22 (see FIG. 7). Two hooks 24 are formed integral with the inside wall 23 of the upper frame board 22 at two opposite sides corresponding to the hooks 18 at the hook rods 17 of the key cap 10. When the key cap 10 is moved upwards, the hooks 18 of the hook rods 17 are respectively stopped at the hooks 24 in the upper frame board 22 to limit upward movement of the key cap 10 relative to the key switch base 20 (see FIG. 4). The rubber cone 30 is mounted inside the bottom frame board 26 and supported on the membrane circuit 40 above the frame 50, comprising a peripheral flange 36 retained between the bottom edge of the bottom frame board 26 and the membrane circuit 40, a top bearing portion 32, which supports the plunger 12 of the key cap 10, and a triggering rod 34 suspended on the inside and spaced above the membrane circuit 40. When the key cap 10 is depressed with the finger, the plunger 12 is lowered with the key cap 10 to compress the rubber cone 30, thereby causing the triggering rod 34 of the rubber cone 30 to trigger a corresponding contact at the membrane circuit 40, and therefore the membrane circuit 40 is driven to output a signal to the computer. On the contrary, when the finger is released from the key cap 10, the rubber cone 30 immediately returns to its former shape, thereby causing the key cap 10 to be pushed back to its former position.

As indicated above, the plunger 12 has guide ribs 13 and 14 disposed in contact with the inside wall 23 of the upper frame board 22, and the upper frame board 22 of the key switch base 20 has two hooks 24 bilaterally disposed on the inside at the top for stopping the hooks 18 at the hook rods 17 to limit up stroke of the key cap 10, the key cap 10 can be smoothly stably moved up and down relative to the key switch base 20 within a limited range.

While only one embodiment of the present invention has been shown and described, it will be understood that various modifications and changes could be made thereunto without departing from the spirit and scope of the invention disclosed.

What the invention claimed is:

1. A computer key switch comprising a frame, a membrane circuit mounted on said membrane, a key switch base mounted on said membrane circuit, a rubber cone supported on said membrane circuit inside said key switch base, and a key cap coupled to said key switch base for depressing by hand to compress said rubber cone in triggering said membrane circuit to output a signal, wherein said key cap comprises a downwardly extended plunger of H-shaped cross section, and two symmetrical hook rods, said plunger comprising eight longitudinally extended guide ribs formed integral with the periphery thereof and disposed in contact with an inside wall of said key switch base for enabling said key cap to be moved up and down relative to said key switch base; said key switch base is a hollow shell comprising an upper frame board, and a bottom frame board, said upper frame board being a hollow, rectangular structure in which the plunger of said key cap is moved up and down with said key cap, an inside wall disposed in contact with the guide rids of the plunger of said key cap, and two hooks formed integral with said inside wall at two opposite sides corresponding to said hook rods to limit up stroke of said key cap; said rubber cone is mounted inside said bottom frame board and supported on said membrane circuit above said frame, comprising a top bearing portion, which supports the plunger of said key cap, and a triggering rod suspended on the inside and spaced above said membrane circuit for triggering a contact at said membrane circuit upon down stroke of said key cap.

2. The computer key switch of claim 1 wherein said hook rods are symmetrically longitudinally suspended in open spaces defined in said plunger at two opposite sides, each having a bottom end terminating in an outwardly protected hook.

3. The computer key switch of claim 2, wherein the hooks in said upper frame board of said key switch base respectively fit the hooks at the hook rods of said key cap.

* * * * *